United States Patent [19]

Jay

[11] 3,945,501

[45] Mar. 23, 1976

[54] STORAGE RACK WITH INTERNESTABLE STACKING ATTACHMENTS

[75] Inventor: Richard S. Jay, Evanston, Ill.

[73] Assignee: Jarke Corporation, Chicago, Ill.

[22] Filed: Apr. 14, 1975

[21] Appl. No.: 567,810

[52] U.S. Cl. ..... 211/177; 108/53

[51] Int. Cl.² ..... B65D 19/38

[58] Field of Search ..... 211/177, 126, 182; 108/53, 108/91; 297/239; 206/505, 507

[56] References Cited

UNITED STATES PATENTS

| | | | |
|---|---|---|---|
| 3,193,093 | 7/1965 | Hansen | 108/53 X |
| 3,246,927 | 4/1966 | Klassen | 297/239 |
| 3,762,343 | 10/1973 | Thacker | 108/53 |
| 3,857,494 | 12/1974 | Giardini | 108/53 X |

*Primary Examiner*—Roy D. Frazier
*Assistant Examiner*—Robert W. Gibson, Jr.
*Attorney, Agent, or Firm*—Dominik, Knechtel, Godula & Demeur

[57] ABSTRACT

There is disclosed an internestable storage rack for accommodating storage of goods, the rack having internestable attachments, and consisting of a series of four vertically and rectangularly oriented support posts, front and rear lower brace members fixedly secured to an interconnecting opposed support post, a pair of opposed lower cross brace members secured to the front and rear lower brace members to form a rigid lower assembly, a rear upper brace member fixedly secured to opposed support posts, a pair of opposed upper side brace members secured to and interconnecting opposed and cross oriented ones of the support posts, the rear upper brace member being off-set and positioned externally of the corresponding and cross oriented support posts, nesting means positioned on top of each of the vertical support posts, mating nestable means for matingly nesting with the nesting means, at least one pair of nestable means mounted on and extending downwardly from the offset and externally positioned upper rear brace, and stabilizing means mounted on the opposed upper side brace thereby to stabilize the rack when internested with other similar racks in a vertically offset stacking posture.

9 Claims, 12 Drawing Figures

STORAGE RACK WITH INTERNESTABLE STACKING ATTACHMENTS

BACKGROUND OF THE INVENTION

A variety of storage racks of diverse constructions are known in the art, and generally such racks are constructed with specific goals in mind. In general, the provision of storage racks has the end goal of providing a maximum quantum of storage space utilizing a minimum of floor area. For this reason, it has been deemed advisable to construct and design storage racks which permit vertical stacking of one rack atop the other in order to maximize vertical storage of materials as opposed to spreading the storage of materials horizontally over a warehousing space.

Another feature of known storage racks relates to the particular materials which are to be stored. For example, some of the storage racks developed in the art are specific with respect to cylindrical loads whereas others are specifically designed for the vertical storage of flat sheet materials. For example, U.S. Pat. No. 3,844,600, issued in the name of the assignee of the present invention, is specifically directed to a storage rack which accommodates the storage of large cylindrical loads, while at the same time permitting the rack to be transported either by way of conventional fork lift trucks, or by way of lifting cranes and the like. Hence, it will be observed that the rack has specific features which permit not only the transport of the subject rack, but also features which accommodate the vertical stacking of racks one atop the other. Similarly, other racks have been designed with a view toward the convenient storing of larger flat sheet materials such as the rack depicted in application Ser. No. 418,859, entitled "Improved Unitized Modular Rack for Vertical Storage of Flat Sheet Materials," owned by the assignee of the present invention. The storage rack depicted therein is constructed in a manner to permit the modularization of the component parts of the rack such that a rack of a size sufficient to accommodate only those materials to be stored may be constructed on the situs of the warehouse facility. In short, by modularizing the component parts, the operator need not have empty storage bins on the floor to take up useable warehouse space when there are no materials to store.

Still other racks which have a variety of features convenient for not only storing materials, but also permitting the stacking of the racks one upon the other is shown in U.S. Pat. No. 3,565,018, also owned by the assignee of the present invention. The rack depicted in this patent is of the type permitting the easy storage of materials on a rack having a pair of opposed side walls and also including a series of four truncated feet which nest within nesting seats in order to permit the vertical stacking of the racks one atop the other. The advantageous feature of the rack depicted in the aforementioned patent is the fact that side walls are foldable into a flat orientation such as to permit the easy storage of the rack when not in use. A variety of other similarly hinged storage racks are known wherein the side walls or side and front and rear walls are all collapsible in order to permit the storage rack to be disassembled and stored within a minimum amount of storage space when not in use.

With respect to those racks having collapsible side walls or front and rear walls, or both, such racks have generally been found to be quite useful in that the same may be disassembled for ease of storage. However, where significant loads are to be stored within the rack and the racks then stacked vertically, the point of the hinged interconnection of the side walls or front and rear walls with the base generally presents a point of stress which cannot take heavy loads. Hence, while one obtains the feature of ease of disassembling and stacking of these racks within a minimum of storage space, one must give up the rigidity generally attributable to solid racks lacking any hinged members.

As to those racks which have been developed having rigid and non-hinged support posts or front and rear walls, generally these racks have been very difficult to store since they do not lend themselves to storage within a minimum amount of warehousing space.

OBJECTS AND ADVANTAGES

The object of the present invention is to provide a rigid storage rack which eliminates any hinged members, in order to accommodate the storage of materials between a series of four support posts and lying on a rigid base, while at the same time, the rack is provided with internestable attachments or components thereby to permit ease of storage stacking when not in use to achieve the storage of the racks in a minimum amount of warehousing space.

A further object of the invention is to provide a storage rack formed by a series of four vertically and rectangularly oriented support posts, front and rear lower brace members fixedly secured to an interconnecting opposed adjacent support post, a pair of opposed lower cross brace members fixedly secured to an interconnecting the front and lower brace members to form a rigid lower assembly, a rear upper brace member fixedly secured to an interconnecting opposed adjacent support posts, a pair of opposed upper side brace members fixedly secured to an interconnecting opposed and cross oriented ones of the support posts, at least the upper rear brace member being offset and positioned externally of the corresponding opposed and cross oriented support posts, nesting means positioned on top of each of the vertical support posts, mating nestable means for matingly nesting with the nesting means, at least one pair of the nestable means mounted on and extending downwardly from the offset and externally positioned upper rear brace member, and stabilizing means mounted on the opposed upper side brace members thereby to stabilize the rack when internestable with other similar racks in a vertically offset stacking posture, such that the provision of at least one upper brace member having at least one pair of nestable means mounted thereon permits the rack to be internestably stacked atop another similar rack by matingly nesting the nestable means with a nesting means such that the racks will stack in a vertically offset orientation one with respect to the other.

In connection with the foregoing object, it is yet a further object of this invention to provide a storage rack of the type described wherein the nesting means comprises a series of four nesting cups, each of the cups fixedly secured on top of a corresponding support post.

In further connection with the above-noted objects and advantages, it is a further object to provide a storage rack of the type described wherein each of the opposed upper side brace members and rear brace member are offset and positioned externally of the corresponding opposed and cross oriented support posts in order to further facilitate the offset vertical stacking of the racks when in the internested posture.

Still a further object of this invention is to provide a storage rack of the type described wherein the nestable means comprises a pair of nesting wedge plates mounted on the upper rear brace member in horizontal alignment with respect to the nesting cups and extending downwardly therefrom such that upon the positioning of one rack upon another in internestable orientation, the wedge plates will nest within the corresponding opposed nesting cups.

In connection with the foregoing object, it is still a further object of this invention to provide a rack of the type described which further includes a pair of rest plates fixedly secured to and mounted between a corresponding upper side brace member and a vertical support post and positioned in opposed relation to said corresponding wedge plates such that when the rack is positioned in internestable stacking relation with another rack, the wedge plates nest within the nest cups of the lower rack to support the front of the stacked rack while the rest plates seat atop the opposed nest cups of the lower rack to support the rear of the stacked rack.

Another object of this invention is to provide a storage rack of the type described which accomplishes all of the foregoing objects and advantages but relates to an alternate embodiment and wherein the nesting means comprises a series of tubular members, two of the tubular members mounted on the interior walls of corresponding support posts and extending downwardly therefrom, and the remaining two tubular members mounted on the upper rear support brace member being offset and positioned externally of the corresponding opposed support post and extending downwardly therefrom, and the nestable means each comprising a tubular rod mounted on and extending upwardly from the top end of each of the support posts such that upon positioning of one rack upon another in internestable orientation, the tubular rods nest within the corresponding tubular members to effect an offset internestable stacking orientation of the racks.

Further features of the invention pertain to the particular arrangement of the elements and parts whereby the above-outlined and additional operating features thereof are attained.

The invention, both as to its organization and method of operation, together with further objects and advantages thereof, will best be understood by reference to the following specification, taken in connection with the accompanying drawings in which.

SUMMARY OF THE INVENTION

Figure 1:
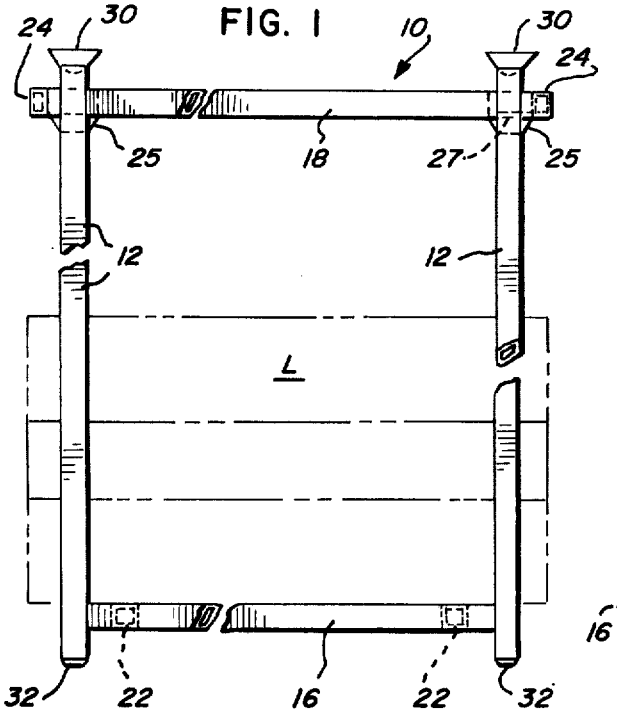
FIG. 1 is a front elevational view of the rack of the present invention showing the internestable attachments as well as having a representative load positioned thereon.
Figure 2:
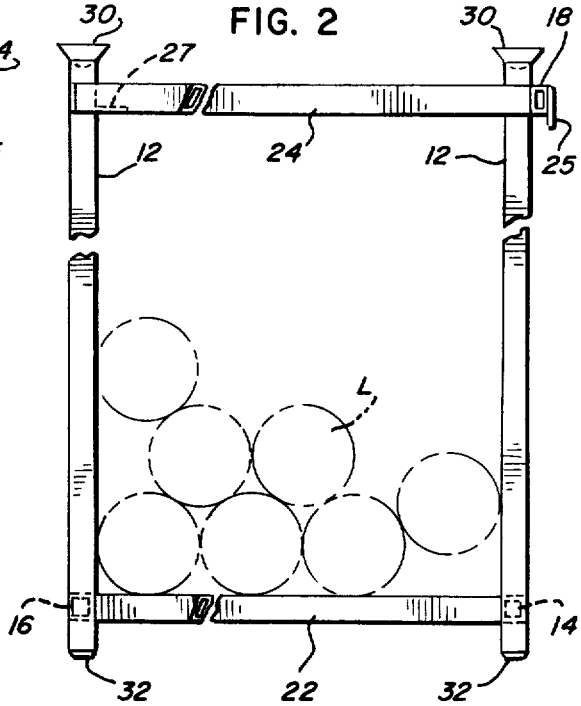
FIG. 2 is a side elevational view of the subject rack shown in FIG. 1 showing a representative load positioned therein, and showing the offset cross brace having the wedge plates extending downwardly therefrom.
Figure 3:
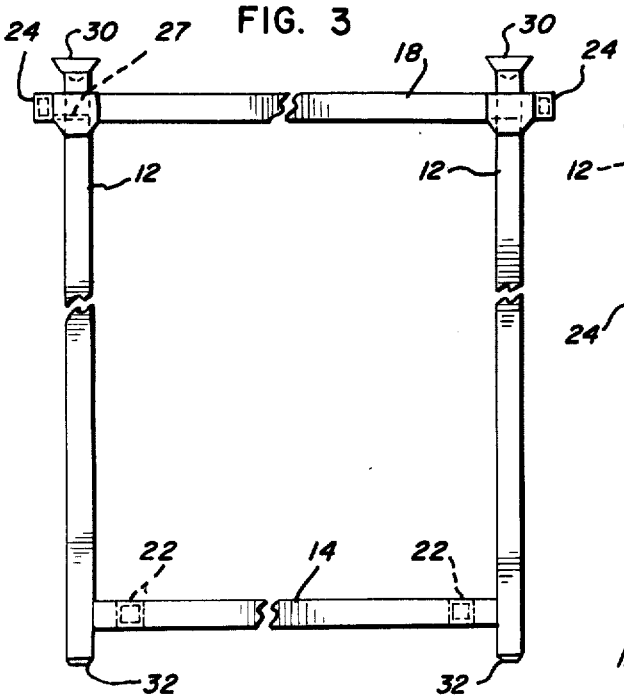
FIG. 3 is a rear elevational view of the subject rack showing the offset cross braces and the nesting wedge plates extending downwardly therefrom.

The present invention is particularly concerned with the provision of a solid and rigid storage rack for accommodating the storage of materials, the rack eliminating any hinged or pivotal members, but nevertheless, including internestable stacking attachments to permit ease of vertically offset internestable stacking when not in use thereby to conserve warehousing space. The rack of the present invention is provided with nesting means which may be formed either by a nesting cup, or by tubular members, and nestable means which consist of either wedge plates in association with the nesting cups, or tubular rods in association with the tubular members, at least one pair of either the nesting wedge plates, or tubular members, being offset with respect to the opposed cross oriented support posts such that the racks, when stacked, are positioned in vertically offset orientation in order to achieve the internestable stacking thereof. In this manner, a rigidly constructed rack is provided to accommodate the storage of heavy loads, while at the same time permitting such rigid racks to be internestably stacked to minimize the amount of warehousing space necessary in order to store such racks when not in use.

DETAILED DESCRIPTION OF INVENTION

Referring now to the drawings, the internestable rack generally indicated by the numeral 10, is shown to be formed by a series of four vertically oriented support posts 12, joined at the bottom by a lower rear brace member 14, a lower front brace member 16, and lower cross brace members 22. It will be observed that the lower cross brace members 22 are horizontally inset from the side edges of the rack thereby to provide a sturdy and rigid support for a load L stored thereon. The upper portion of the rack 10 is shown to include an upper rear brace member 18, and upper cross brace members 24. In the preferred embodiment, the brace members 14, 16, 18, 22, and 24 are fixedly secured to the corresponding vertically oriented support posts 12 by any suitable means such as welding or the like. It will be observed that the end result is a very rigid and sturdy storage rack 10 which permits the loading and storage of a significantly heavier load then is permitted by a rack of the type having hinged members to form the sides thereof.

It will also be observed that in order to further add stability and rigidity to the rack, the brace members as described above as well as the vertical support posts 12 are formed of tubular steel. Quite obviously, any rigid material may be utilized for the various brace members and support posts, and it is considered to be merely a matter of design choice as to whether tubular steel or other metallic materials or indeed plastic materials are to be utilized.

Figure 4:
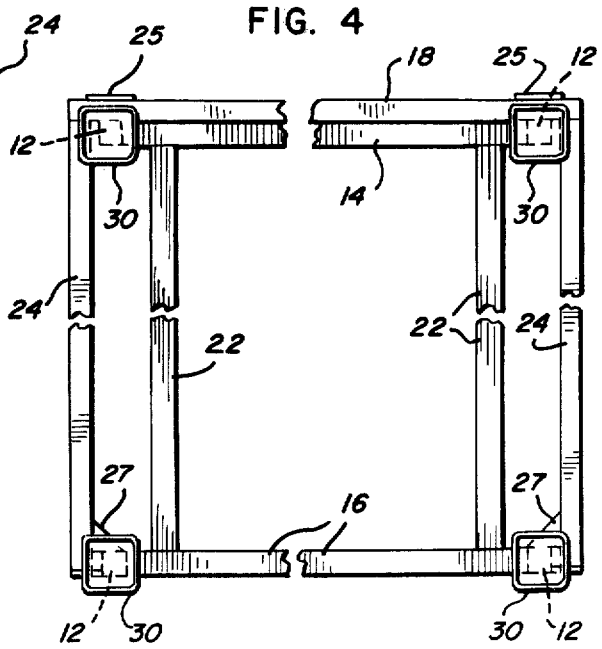
FIG. 4 is a top view of the rack of the present invention illustrating the positioning of the nesting wedge plates, nesting cups, and rest plates associated therewith.

In the embodiment illustrated in FIGS. 1 through 7 of the drawings, it will be observed that the upper rear brace member 18 is horizontally offset and positioned externally of the corresponding support post 12. This construction is provided by similarly offsetting the upper cross brace members 24 to be positioned externally of the corresponding support posts 12 and thereby to permit the welding or other securement of the upper rear brace member 18 to not only the corresponding support post 12 but also to the outer edges of the upper cross brace members 24. This construction is illustrated in FIG. 4 of the drawings.

Figure 7:
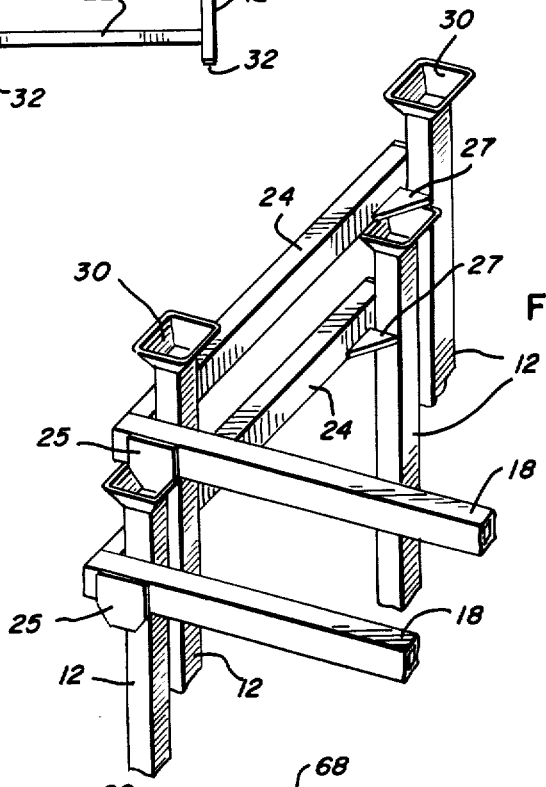
FIG. 7 is a plan view, partly cut away, showing, in greater detail, the means by which the subject storage racks are internestable one with respect to the other.

It will be observed that the upper rear brace member 18 is provided with a pair of nesting wedge plates 25 fixedly secured to the upper rear brace member 18 by any suitable means such as welding or the like, and extend downwardly for a distance beyond the lower edge of the rear brace member 18. In addition, the rack 10 is provided with a pair of rest plates 27 which are formed by triangular metallic members, fixedly secured between the upper cross brace members 24 and the corresponding support post 12. As shown in FIG. 7 of the drawings, the rest plates 27 are fixedly secured such as by welding or the like at a point immediately adjacent to the lower end of the upper cross brace members 24 and to the corresponding support post 12.

Figure 5:
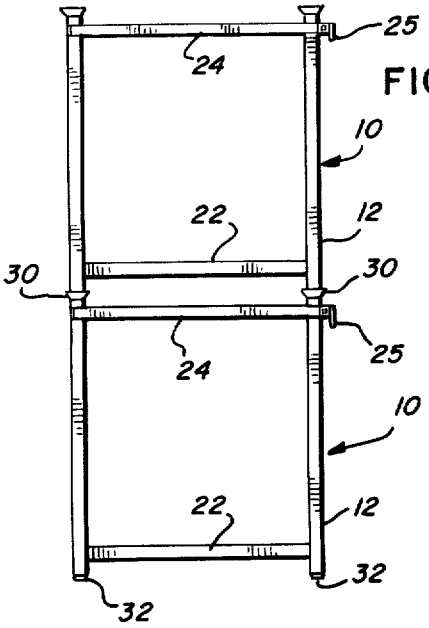
FIG. 5 is a side elevational view of two of the subject racks positioned in vertical stacking orientation.

The top end of each of the vertical support posts 12 is provided with a nesting cup 30 which, in the present embodiment, takes the form of a substantially rectangular open cup bounded by side walls and suitably secured to the upper ends of the support post 12 by welding or the like. It will further be noted that each of the support posts 12 includes a tapered lower end depicted by the numeral 32 which serves the purpose of facilitating the stacking mode as shown in FIG. 5 of the drawings.

It will be observed that the nesting cups 30 serve the dual purpose of providing a nest for the tapered ends 32 of the support posts 12 when in the stacking mode (FIG. 5), as well as providing a nest for the wedge plates 25 when the racks 10 are positioned in the internesting storage mode, as shown in FIG. 7 of the drawings.

Figure 6:
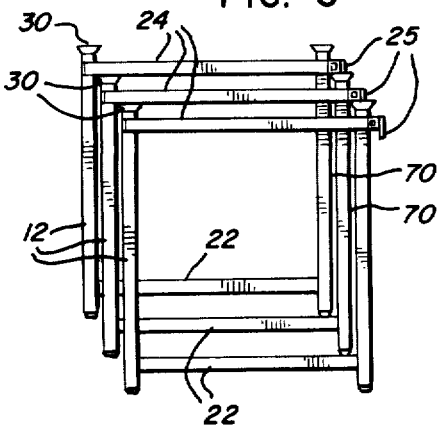
FIG. 6 is a side elevational view showing a series of three of the subject racks positioned in vertically offset internestable stacking relationship for storage purposes.

With respect to the internesting storage mode, it will be observed that the pair of wedge plates 25 secured to the upper rear brace member 18 are positioned within a pair of corresponding nesting cups 30 thereby to support the upper rear portion of the rack 10, while the rest plates 27 are supported on the opposed pair of nesting cups 30 on a lower rack thereby to support the front portion of the rack 10. It will also be observed that by having the upper rear brace member 18 offset with respect to the corresponding support posts 12, the internestable storage mode for stacking and storing racks when not in use assumes an offset vertical orientation as shown in FIG. 6 of the drawings. It is therefore clear that by constructing the rack 10 in the manner described above, a rigid rack may be provided which nevertheless permits a storage mode to be achieved by stacking a plurality of such racks while utilizing a minimum of warehousing space when stored in the manner described. Hence, it is possible to provide a rigid storage rack for storing heavy weight materials thereby eliminating pivoted or hinged members while at the same time providing a rack which accommodates and permits ease of storage.

It will further be observed that the lower rear brace member 14, lower front brace member 16, and lower cross brace members 22 are positioned, as an assembly, a distance spaced upwardly from tapered ends 32 of the support posts 12. In this manner, sufficient space is provided for the use of any load transport vehicle such as a fork lift truck or the like. Additionally, and where desired, bails, hooks, or rings may be secured to the rack 10 as a means for adapting for crane pickup and movement.

In FIGS. 8 through 11 of the drawings, an alternate embodiment of the subject storage rack is illustrated. The alternate rack 50 similarly formed by a series of four vertical support posts 52 provided with a lower assembly including a lower front brace 58, lower rear brace 60, and a lower cross brace 56. The upper portion of the rack 50 is provided with an upper rear brace 62, and upper cross brace members 64 interconnected between opposed vertical support posts 52 respectively. The upper rear support brace 62 is mounted on and extends between corresponding opposed support posts 52, the upper cross brace members 64 extending laterally across the terminal ends of the rear brace member 62. The upper cross brace members 64 are mounted to and interconnected between the upper rear brace 62 and support post extension plates 65.

It will further be observed that a series of four tubular nest members 66 are provided, two of the tubular nest members 66 being mounted along the inner surface of the support posts 52 and extending downwardly therefrom for a distance and two of the tubular nest members 66 being mounted to the lower surface of the upper rear support brace 62 and extending therefrom.

Figure 11:
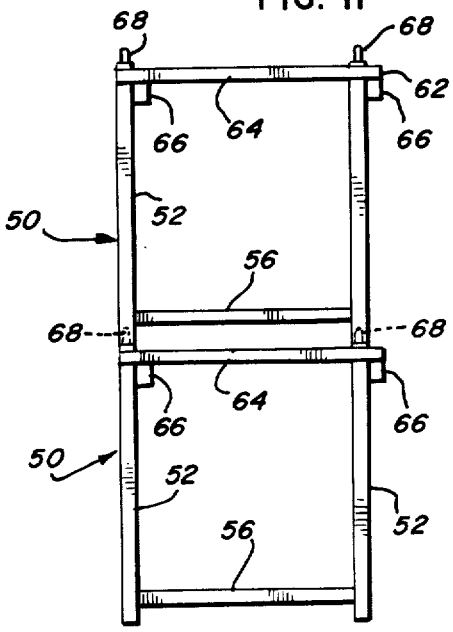
FIG. 11 is a side elevational view showing the stacking mode of the alternate form of the rack of the present invention.
Figure 8:
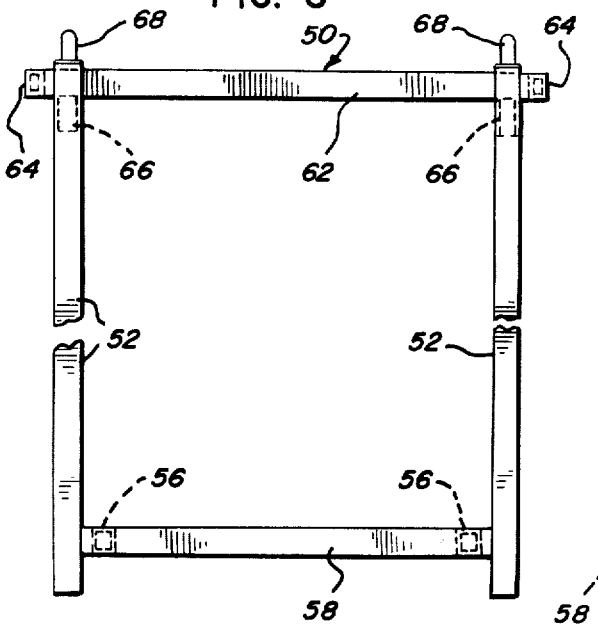
FIG. 8 is a front elevational view of an alternate embodiment of the present invention wherein the nestable means consists of a series of tubular rods extending upwardly from each of the vertical support posts to achieve the vertically offset internestable orientation during stacking.
Figure 9:
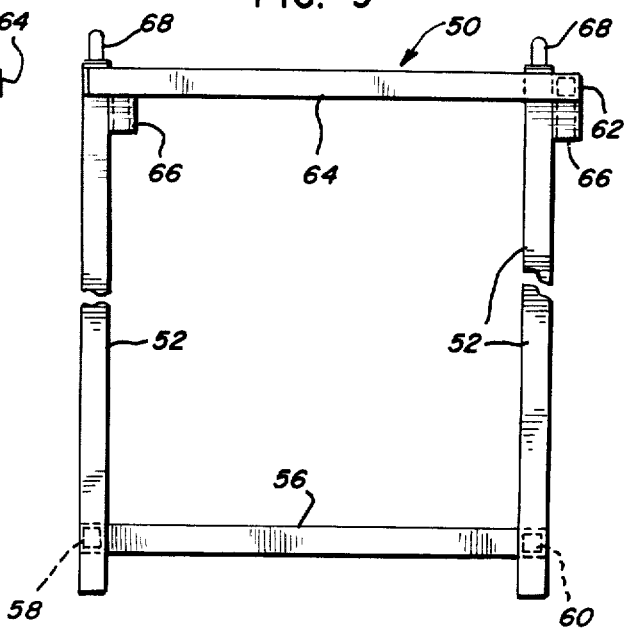
FIG. 9 is a side elevational view of the rack shown in FIG. 8 showing the combination of the nestable means consisting of tubular rods and the nesting means consisting of tubular members extending downwardly from the upper side brace members thereby to achieve the vertically offset internesting stacking relationship.
Figure 10:
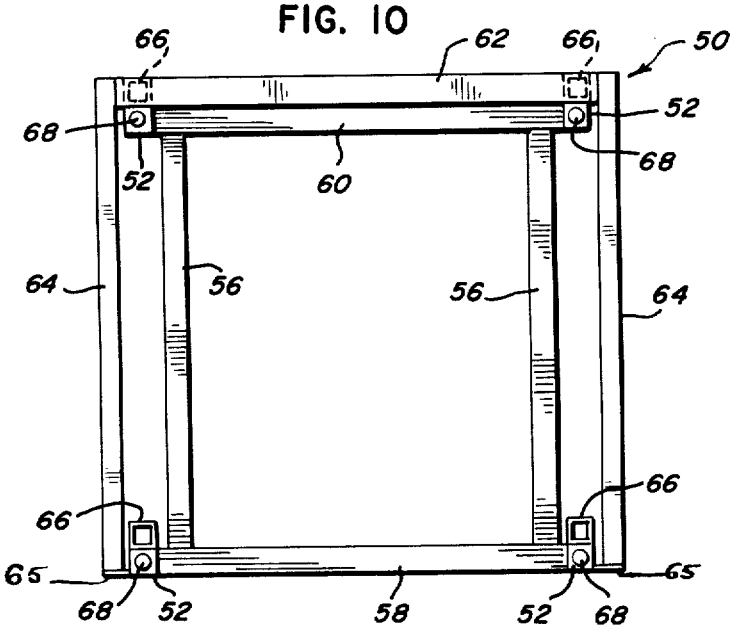
FIG. 10 is a top view showing the details of construction of the rack as depicted in FIGS. 8 and 9 of the drawings.

In addition, each of the vertical support posts 52 are provided with tubular rods 68 extending upwardly from the top end of the corresponding support posts 52, the tubular rods 68 being dimensionally sized such that the same will fit within the corresponding tubular nest members 66. In the preferred embodiment, and indeed in order to effect a functional useage of the racks for both stacking as well as storing purposes, the vertical support posts 52 are hollowed or tubular at the lower ends thereof, the hollow in the lower ends of the support posts 52 being dimensionally sized to accommodate in nesting relationship the tubular rods 68 therein. FIG. 11 of the drawings clearly illustrates the stacking mode for the subject racks when in use.

Figure 12:
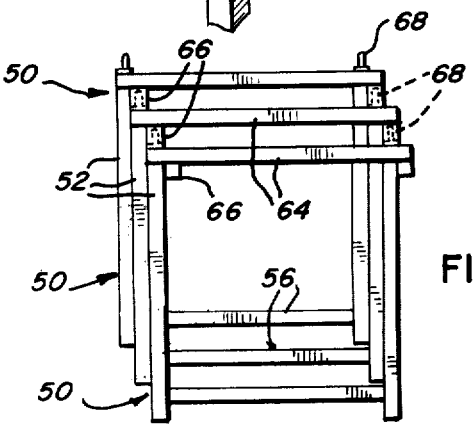
FIG. 12 is a side elevational view showing the vertically offset internestable stacking relationship of a series of three of such racks when stacked for storage purposes.

FIG. 12 of the drawings illustrates the internestable storage mode for the alternate rack 50 and indicates the manner in which the racks 50 may be stored one atop the other. In this connection, it will now be apparent that in order to accomplish a vertically offset internestable stoage mode, the tubular nest member 66 must be vertically offset with respect to the corresponding vertical support post 52. It will be observed that the four tubular nest members 66 are positioned on the next adjacent rack such that the tubular rods 68 to the support rack positioned below nest within the tubular nest member 66 of the supported or stacked rack thereby to permit an internestable storage mode wherein the racks are vertically offset one with respect to the other.

The principal advantage achieved by the construction of the alternate form of rack 50 as opposed to the rack as shown and described in FIGS. 1 through 7 of the drawings may be observed by comparing FIGS. 6 and 12 of the drawings. It will be noted that the internested storage mode for the rack 10, a gap depicted by the numeral 70 exists between each of the adjacent racks. Alternatively, the construction of the alternate rack 50 is such that when the racks are positioned in the internestable storage mode in vertically offset orientation the racks fit such that the vertical support posts 52 of each adjacent rack are flush with the next adjacent rack. In this manner, this type of rack will fit more easily into critical spaces which often times is a requirement for the shipment of such racks in vehicles such as street trucks or vans.

It will be appreciated from the above description that various alternative embodiments may be designed which accomplish the similar purpose. Generally, any design may be utilized wherein the nesting attachments for the rack are positioned offset with respect to the corresponding vertical support posts such that when the racks are internestably stored, a vertically offset storage mode is achieved. Hence, a hook and rod arrangement could be utilized, as well as various other types of nesting elements. It will be appreciated that the present invention provides a rigid and sturdy storage rack which may accommodate storage of heavy loads by eliminating any pivoted or hinged members associated with the rack, while at the same time, including nesting attachments which permit the internestable storage of a plurality of such racks in the minimum amount of warehousing space. In addition, the racks of the present invention provide not only a sturdy lower assembly to support a load, but also provide a sturdy and rigid upper brace assembly in order to minimize and resist forces tending to deflect the posts out of coupling or stacking engagement. This is an important design feature when it is considered that each of the racks may be loaded with a load L of heavy materials and one rack stacked vertically upon another similarly loaded rack. Hence, these as well as other advantages are provided by a rack designed in accordance with the description as set forth above. It is, therefore, appreciated that all of the objects and advantages have been accomplished by means of the storage racks depicted herein and the various embodiments thereof to provide a compact but rigid and internestable storage rack.

While there has been described what is at present considered to be the preferred embodiments of the invention, it will be understood that various modifications may be made therein and it is intended to cover in the appended claims all such modifications as fall within the true spirit and scope of the invention.

I claim:

1. A rigid internestable storage rack for accommodating the storage of heavy loads positioned in horizontal orientation, said rack being further adapted for transport by conventional transport vehicles such as fork lift trucks and the like, the combination comprising, a series of four vertically and rectangularly oriented support posts, front and rear lower brace members fixedly secured to and interconnecting opposed adjacent support posts, a pair of opposed lower cross brace members fixedly secured to and interconnecting said front and rear lower brace members thereby to form a rigid lower assembly for said rack, an upper rear brace member fixedly secured to and interconnecting opposed adjacent support posts, a pair of opposed upper cross brace members fixedly secured to and interconnecting opposed and cross oriented ones of said support posts.

at least said upper rear brace member being offset and positioned externally of said corresponding opposed and cross oriented support posts, nesting means positioned on top of each of said vertical support posts, mating nestable means for matingly nesting with said nesting means, at least one pair of said nestable means mounted on and extending downwardly from said offset and externally positioned upper rear brace member.

and stabilizing means mounted on the upper portion of said rack in opposed relation to said nestable means thereby to stabilize said rack when internested with other similar racks in a vertically offset stacking posture.

whereby the provision of at least one upper brace member having at least one pair of said nestable means mounted thereon permits said rack to be internestably stacked atop another similar rack by matingly nesting said nestable means with said nesting means such that said racks will stack in vertically offset orientation one with respect to the other.

2. The storage rack as set forth in claim 1 above, wherein said lower cross brace members are each horizontally and inwardly offset with respect to the corresponding support post.

3. The storage rack as set forth in claim 1 above, wherein each of said opposed upper side brace members are offset and positioned externally of said corresponding opposed and cross oriented support posts and wherein each is fixedly secured to said corresponding support posts and rear upper brace members, and said upper rear brace member is horizontally offset and positioned externally of said corresponding support posts.

4. The storage rack as set forth in claim 1 above, wherein said nesting means comprises a series of four nesting cups, each of said cups fixedly secured atop a corresponding support post.

5. The storage rack as set forth in claim 4 above, wherein each of said nesting cups is rectangular in configuration.

6. The storage rack as set forth in claim 4 above, wherein said nestable means comprises a pair of nesting wedge plates mounted on said upper rear brace member in horizontal alignment with said nesting cups and extending downwardly therefrom such that upon the positioning of one rack upon another in internestable orientation, said wedge plates nest within the corresponding opposed nesting cups.

7. The storage rack as set forth in claim 6, above, wherein said stabilizing means comprises a pair of rest plates fixedly secured to and mounted between a corresponding upper side brace member and vertical support posts, and positioned in opposed relation to said corresponding wedge plates such that when said racks are positioned in internestable stacking relation, said wedge plates nest within the nest cups of a lower rack to support the rear of the stacked rack while said rest plates seat atop the opposed nest cups of the lower rack to support the front of the stacked rack.

8. The storage rack as set forth in claim 1 above, wherein said nestable means comprises a series of four tubular members, two of said tubular members mounted on opposed vertical support posts internally thereof and extending downwardly therefrom, and the remaining two of said tubular members mounted on said upper rear support member and extending downwardly therefrom.

9. The storage rack as set forth in claim 8 above, wherein said nesting means each comprises a tubular rod mounted on and extending upwardly from the top end of each of said support posts such that upon positioning of one rack upon another in internestable orientation, said tubular rods nest within the corresponding tubular members to effect an offset internestable stacking orientation of said racks.

* * * * *